US005207320A

United States Patent [19]

Allen

[11] Patent Number: 5,207,320

[45] Date of Patent: May 4, 1993

[54] COMPARTMENTED MIXING DEVICE WITH BEAD

[76] Inventor: Nicholas J. Allen, Flat 2, 23 Hampsted Lane, Highgate, London N6, United Kingdom

[21] Appl. No.: 776,401

[22] PCT Filed: May 17, 1990

[86] PCT No.: PCT/GB90/00777

§ 371 Date: Jan. 22, 1992

§ 102(e) Date: Jan. 22, 1992

[87] PCT Pub. No.: WO90/14293

PCT Pub. Date: Nov. 29, 1990

[30] Foreign Application Priority Data

May 24, 1989 [GB] United Kingdom ..... 8911878

[51] Int. Cl.[5] ..... B65D 25/08; B67B 5/60

[52] U.S. Cl. ..... 206/220; 53/452; 53/469; 53/474; 206/459.5; 222/94; 366/342; 383/38; 604/416; 604/903

[58] Field of Search ..... 206/219-221, 206/459; 604/416, 903, 415; 366/342; 215/DIG. 8; 222/145, 94, 129; 383/38; 53/469, 479, 452

[56] References Cited

U.S. PATENT DOCUMENTS

| | | | |
|---|---|---|---|
| 2,487,236 | 11/1949 | Greenberg | 206/220 |
| 2,660,171 | 11/1953 | Dickenson | 206/221 |
| 3,451,540 | 6/1969 | Kulischenko | 206/220 |
| 3,478,871 | 11/1969 | Sager . | |
| 3,608,709 | 9/1971 | Pike | 53/474 X |
| 3,674,028 | 7/1972 | Ogle | 206/221 |
| 3,749,620 | 7/1973 | Montgomery . | |
| 3,796,303 | 3/1974 | Allet-Coche | 604/416 X |
| 3,847,274 | 11/1974 | Montgomery | 206/219 |
| 3,917,063 | 11/1975 | Chibret et al. | 206/221 |
| 4,197,943 | 4/1980 | Weikel | 206/219 |
| 4,402,402 | 9/1983 | Pike | 206/219 |
| 4,591,357 | 5/1986 | Sneider | 604/416 |
| 4,608,043 | 8/1986 | Larkin . | |
| 4,632,244 | 12/1986 | London | 206/219 |
| 5,154,321 | 10/1992 | Shomer | 222/145 |

FOREIGN PATENT DOCUMENTS

| | | |
|---|---|---|
| 1054170 | 2/1954 | France . |
| 2069786 | 9/1971 | France . |
| 80841 | 10/1952 | Norway . |
| 670314 | 4/1952 | United Kingdom . |
| 1290422 | 9/1972 | United Kingdom . |

*Primary Examiner*—Bryon P. Gehman

*Attorney, Agent, or Firm*—Wegner, Cantor, Mueller & Player

[57] ABSTRACT

A device comprising a generally cylindrical plastics container sealed at its ends and having an area intermediate said ends defined by one or more temporary seals, thereby dividing the container into two compartments and an intermediate area between the compartments, is provided. The compartment of the container adjacent to one end thereof contains a first material and the compartment of the container adjacent to the other end thereof contains a second material in which the first material is to be dispersed or dissolved prior to use. The intermediate area contains neither the first nor the second material and the temporary seal or seals is or are arranged so that it or they can be broken by finger pressure to permit communication between the outer compartments, thereby permitting mixing of the first and the second materials.

30 Claims, 6 Drawing Sheets

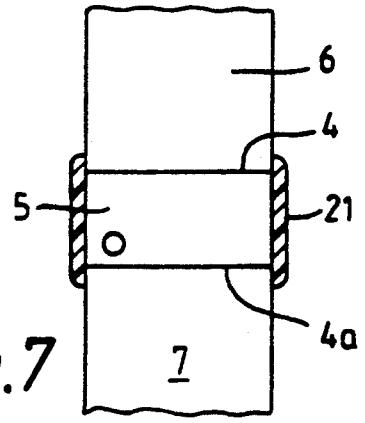
Fig.7
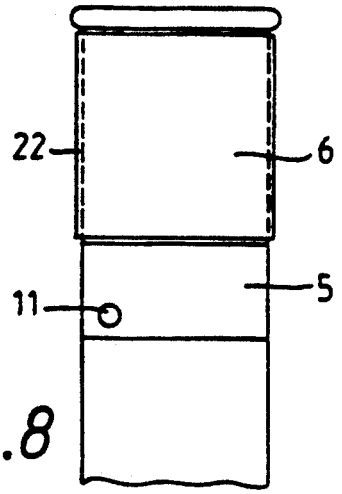
Fig.8
Fig.9
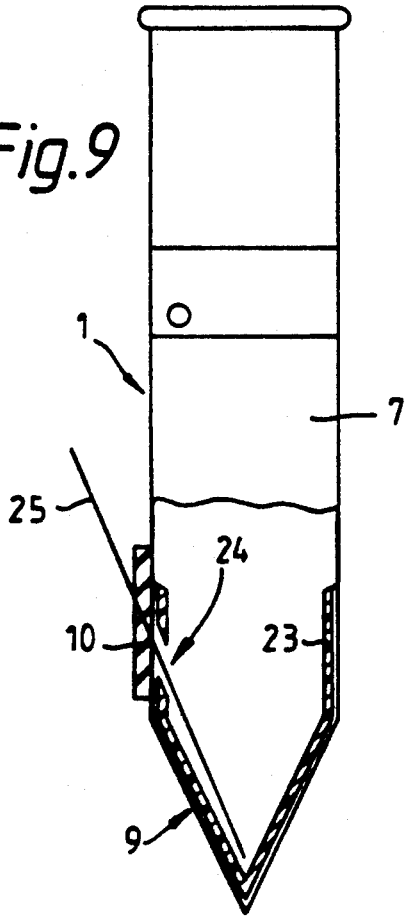
Fig.10
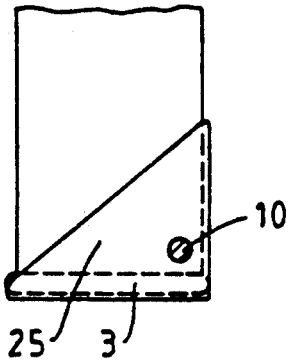
Fig.11
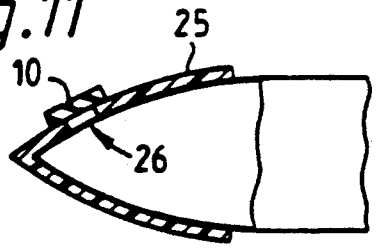
Fig.12
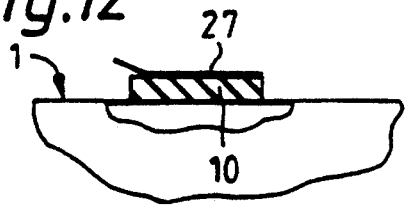

Fig. 13
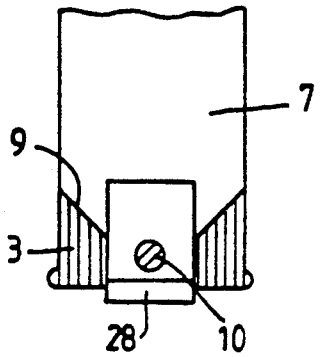
Fig. 14
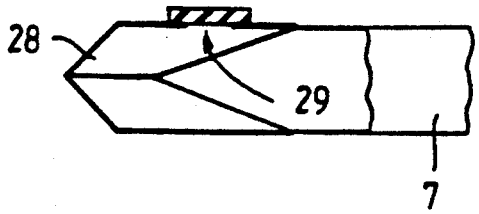
Fig 15
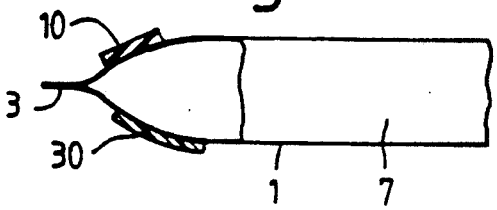
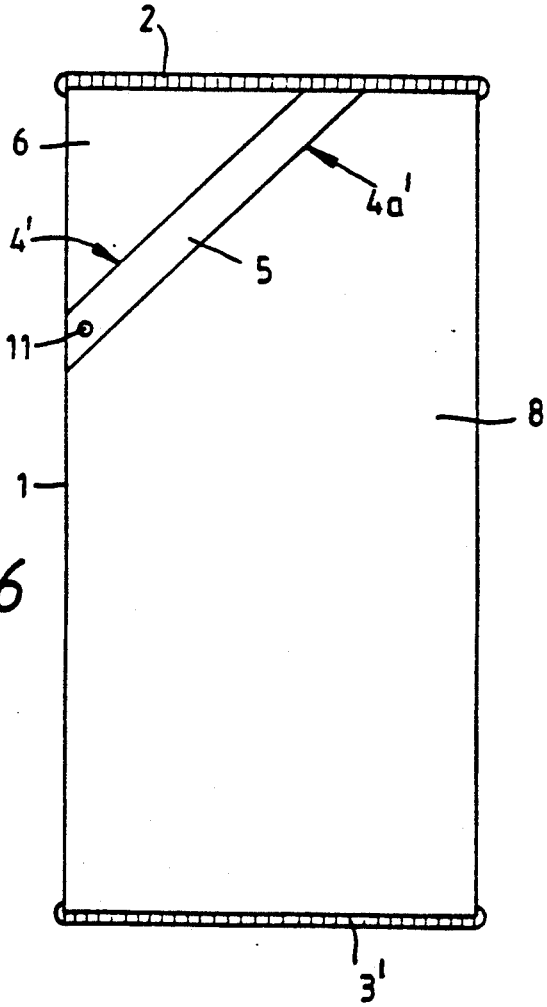
Fig. 16

COMPARTMENTED MIXING DEVICE WITH BEAD

This invention relates to a disposable mixing device, e.g. formed of plastics materials, for packaging two components which are to be mixed prior to use. The invention finds particular application in packaging and storing pharmaceutical compositions, advantageously in unit dosage forms.

It is known to store components which are to be mixed prior to their use in an ampoule with a partition dividing the two compartments For example, French patent No. 1,054,170 published Feb. 9, 1954 discloses containers or ampoules which are compartmentalised in various different ways to facilitate storage and subsequent mixture of two components prior to their use. FIG. 9 in particular discloses an ampoule containing a powdery material in one compartment and a liquid in another compartment, the two compartments being separated by a partition wall which can be made to give way under finger pressure, thereby allowing contact between the two ingredients.

British patent No. 670,314 published Apr. 16, 1952 also discloses a divided ampoule construction having a partition rupturable by finger pressure on either half of the ampoule Such a structure may be formed by local heating and compression of the area where the partition is to be formed, thereby sticking but not fixing the walls of the ampoule together.

In these known containers, there is a danger that liquid contained in one of the compartments may seep around the partition or closure member into the other compartment; this may adversely affect the storage properties of the material contained in the second compartment. Also, if a hygroscopic powder is contained in the second compartment, it may be difficult to detect whether any liquid seepage has occurred.

According to one aspect of the present invention, there is provided a device which comprises a generally cylindrical plastics container sealed at its ends and having a compartment intermediate said ends, defined by temporary seals, thereby dividing the container into three compartments, wherein that compartment of said container adjacent to one end thereof contains a first material and that compartment of said container adjacent to the other end thereof contains a second material in which the first material is to be dispersed or dissolved prior to use characterised in that (a) said intermediate compartment contains a bead but neither said first material nor said second material, and (b) said temporary seals are arranged so that they can be broken by finger pressure to permit communication between the compartments, thereby permitting mixing of said first material and said second material.

The invention will be described hereinafter with reference to its use in clinical applications, although it is to be understood that a device in accordance with this invention may be used for storing and dispensing materials other than pharmaceuticals.

An essential feature of the present invention is the provision of an intermediate area between the two outer compartments which contain the components which are to be mixed prior to their use. The intermediate area greatly assists the user in assessing whether or not the temporary seal or seals has or have maintained its or their integrity, for example, by having a pressure and/or moisture sensitive indicator in this area. Also, if the intermediate area is gas-filled (e.g. with an inert gas such as Nitrogen or with air), the two outer compartments may be air-tight while still allowing ready mixing of their contents. In one embodiment, the intermediate area comprises a single broad temporary seal containing a pressure and/or moisture sensitive indicator.

In another embodiment, the intermediate area of the dispensing device comprises a compartment defined by two temporary seals and may contain a small bead, for example a ceramic bead, which aids in mixing the components in the outer compartments after the two temporary seals have been ruptured. Such a ceramic bead may have on its surface or be impregnated with an indicator sensitive to the liquid contained in the device, so that any seepage of liquid across the temporary seal is evident from (for example) the colour of the ceramic bead. The bead may be any convenient shape, for example conical, spherical, cylindrical, pyramidal or bipyramidal. A shape with a pronounced vertex is useful aiding moisture detection. A further benefit of using such a bead is that it produces a rattling sound when the device is shaken: if seepage of liquid into the intermediate area has occurred, the quality of sound changes. This provides an alternative means of indicating whether the seals have maintained their integrity. The bead may be constructed of a buoyant material so that it floats on the surface of the solution and hence will not interfere with the withdrawal of the solution from the device by a needle and/or syringe.

Advantageously, the ends of the device are sealed by a permanent heat seal. In one embodiment, the seal at one end of the device defines a V-shaped end to the adjacent compartment. After mixing of the ingredients in the device, the V-shape assists in permitting extraction of all of the solution or dispersion from the container.

A dispensing device in accordance with this invention may include a predetermined locus for insertion of a syringe needle. In one embodiment, the device carries on its exterior a small pad which defines the intended puncture site and which assists in providing a seal around the lumen of a syringe needle during use. Alternatively, the device may include at one end thereof an entry channel for a needle or for a syringe, e.g. formed as an injection moulded, rigid plastics or rubber funnel, and may include a seal at the neck of the funnel which is penetrated, in use, by the lumen of a needle.

The entry channel may comprise a funnel which includes a valve at the neck of the funnel, which valve is penetrated in use by the lumen of a needle or by the lumen of a syringe. With such funnel-like needle entry elements, access to the entry point may be protected by a temporary heat seal between flaps of plastics material at the end of the dispensing device which may have a pressure and/or moisture sensitive indicator between the flaps of plastics material. In addition, the entry channel may have a substantially flattened area to assist holding of the device during use. Prior to use, the temporary heat seal will be broken to permit entry of a syringe or needle into the device.

In order to assist the breaking of the or each temporary seal which defines the intermediate area of the device, the exterior of the device may be surrounded, in the vicinity of the intermediate compartment, by a sheath of plastics material, preferably a soft, clear plastics band This has two benefits: firstly, it tends to reduce the risk of the or each temporary seal being accidentally broken during handling of the device prior to its use;

and secondly, it facilitates the breaking of the or each temporary seal without discomfort to the user.

Where the powdered pharmaceutical in one compartment of the device is sensitive to light or oxygen, that compartment of the device may be surrounded by, for example, a foil laminate.

Where a syringe is intended to be inserted into a device of this invention through a side wall thereof, there is a possibility that the needle will penetrate the opposite wall of the device, thus wasting the contents of the dispensing device and possibly causing needlestick injuries to the user. To prevent such adverse effects, the device may include a protective liner, either internally or externally, in the region where syringe insertion is intended to occur.

If desired, a peel-off protective strip may be affixed over a rubber pad which is positioned at the needle insertion point.

The or each temporary seal which defines the intermediate area may be linear, and may be disposed orthogonally with respect to the longitudinal axis of the device. Alternatively, the or each temporary seal may be arcuate in configuration. Where the device is intended to contain a relatively large volume of liquid, e.g. 10 or 20 ml, the or each temporary seal may be disposed obliquely with respect to the longitudinal axis of the device so that, for example, the powdered material is contained in a compartment which is triangular when viewed in the plane containing the temporary seal or seals and the longitudinal axis of the device.

Conveniently, devices in accordance with this invention will provide a unit dosage of the pharmaceutical material which they contain. Typically, the device will contain 250 mg or 500 mg of powdered pharmaceutical material and up to 20 ml liquid. The liquid may be, for example, distilled water, normal saline solution, or glucose solution. Other liquids or solutions may be used when desired.

In preferred embodiments of the invention, the two materials in the outer compartments of the device remain in their separate, air-tight compartments until the temporary seal or seals defining the intermediate area is or are broken by applying finger pressure to the sides of the or each seal. Thereafter, the two materials can be mixed together by shaking the container, after which the mixed solution or dispersion is ready for use. Where the pharmaceutical is to be injected by intravenous or intramuscular injection, agitation of the two components should continue until all of the powdered material is fully dissolved.

In any of the above-mentioned embodiments, the plastics container may be formed from two annularly co-extruded polymers, the inner of said two polymers being relatively less resilient than the outer. The outer polymer may be a different colour to the inner polymer, and may have predetermined portions removed to generate indicia.

After use, a device of this invention can be thrown away into an ordinary dustbin; there is no requirement for a "sharps" bin of the type used for disposable syringes.

The container may be made from a plastics material, e.g. polypropylene, by extrusion. The or each temporary seal can be formed by application of just sufficient heat to cause opposite sides of the tube to stick together without forming a permanent bond. The sealed ends of the device may be formed by application of heat and pressure over a longer period of time, thereby generating a permanent heat seal.

According to another aspect of the present invention, there is provided a method for the production of a device of the present invention which comprises forming said container by extrusion; sealing one end thereof; depositing said first or second material into said container and sealing it therein by means of a temporary seal, depositing said bead into said container and sealing it therein by means of another temporary seal, thereby forming an intermediate compartment; depositing said first or second material into said container and sealing it therein by means of a further seal, wherein said temporary seals are formed by the application of heat to opposite sides of said container so as to cause the sides of the container to stick together without forming a permanent bond and are arranged so that they can be broken by finger pressure.

The seals at the ends of the device may be formed by the application of heat and pressure to opposite sides of the container to generate a permanent heat seal.

According to a further aspect of the present invention, there is provided a method of packaging a pharmaceutical material, which comprises forming a generally cylindrical plastics container by extrusion; sealing one end thereof; depositing a first material into said container adjacent to said sealed end and enclosing it in a first compartment therein by means of a temporary seal; depositing a bead into said container and sealing it therein by means of another temporary seal, thereby forming an intermediate compartment;

depositing a second material into said container and enclosing it therein in a third compartment by means of a further seal, wherein said first material is a pharmaceutical material and said second material is a diluant, or said first material is a diluant and said second material is a pharmaceutical material, and said temporary seals are formed by the application of heat to opposite sides of said container so as to cause the sides of the container to stick together without forming a permanent bond.

A pharmaceutical material packaged in accordance with the above method may be dispensed by breaking each temporary seal defining said intermediate compartment by applying finger pressure to the edges of the seals, shaking the container, and extracting the resulting solution, dispersion or suspension.

For a better understanding of the invention, and to show how the same may be carried into effect, reference will now be made, by way of example, to the accompanying drawings, in which:

FIGS. 7 and 8 illustrate fourth and fifth embodiments, respectively;

FIG. 9 illustrates a sixth embodiment of the invention;

FIGS. 10–15 illustrate alternative constructions of the device at the locus of inserting the lumen of a syringe;

FIG. 16 illustrates a seventh embodiment of the invention;

Figure 1:
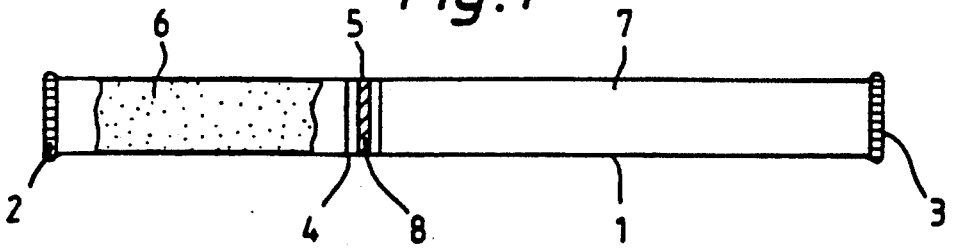
FIG. 1 illustrates a first embodiment of the invention.

Referring now to the drawings, the dispensing device in all of the figures is formed from a clear, plastics tube, e.g. a polypropylene. The tube is clamped and heated at its ends in order to form permanent seals 2 and 3. The tube, indicated by reference 1 in the drawings, is provided with a temporary seal 4, which defines an intermediate area 5. A first outer compartment 6 is defined between end 2 and temporary seal 4, and a second outer compartment 7 is defined between temporary seal 4 and end 3 of the device. In the embodiment illustrated in FIG. 1, the intermediate area contains a pressure and/or moisture sensitive indicator strip 8, and compartment 7 contains a liquid, e.g. water, normal saline or glucose. In the embodiment illustrated in FIGS. 2 and 3, the intermediate area 5 is defined by temporary seals 4 and 4*a*, thereby forming a compartment, and sealed end 3 is shaped so that the compartment 7 terminates in a "V" shape 9. A circular disc 10 of silicone rubber is affixed to the outside of tube 1 adjacent to the vertex of "V" part 9, and defines the locus of insertion of a syringe.

A small ceramic bead 11 is present in intermediate area 5. The bead carries an indicator which changes colour in the presence of a liquid from compartment 7, and is constructed of a buoyant material.

Figure 2:
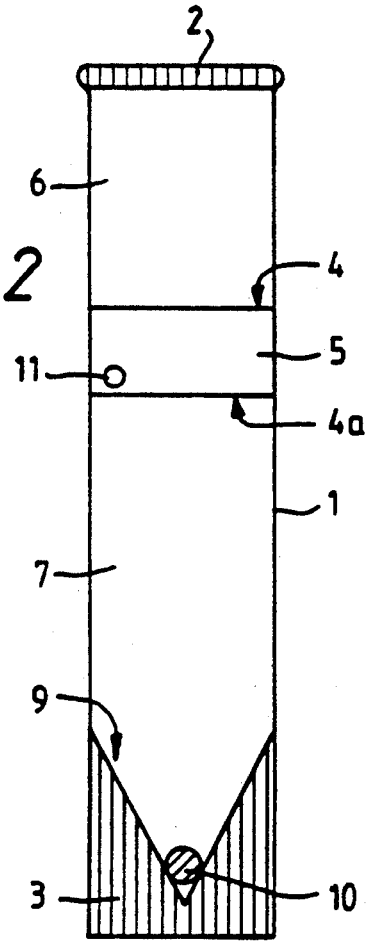
FIGS. 2 and 3 illustrate a second embodiment of the invention.
Figure 3:
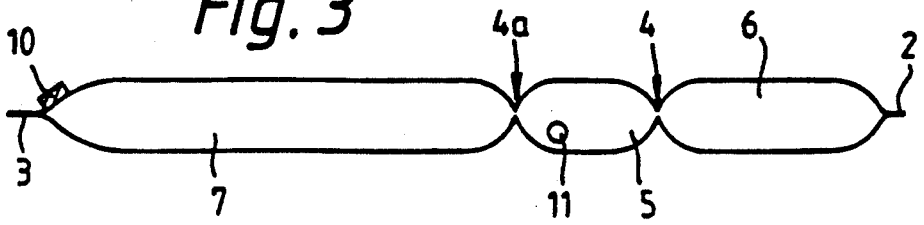
Figure 4:
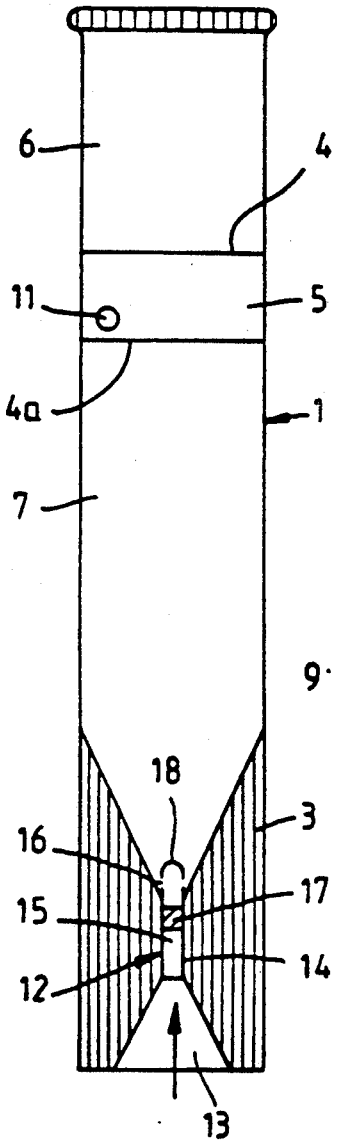
FIGS. 4 and 5 illustrate a third embodiment of the invention.
Figure 5:
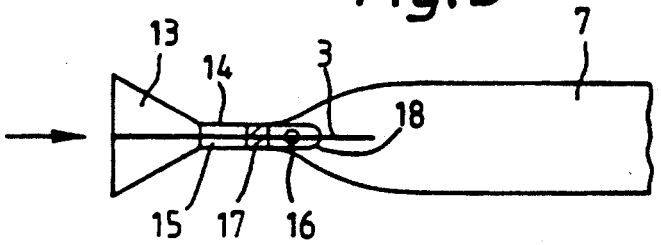

The embodiment shown in FIGS. 4 and 5 is generally similar to that of FIGS. 2 and 3, except that the provisions for inserting a syringe needle take an alternative form. In FIG. 4, the "V"-shaped end 9 of compartment 7 terminates, at the vertex of the "V", in a needle entry device 12. This is formed of a relatively rigid plastics material, and comprises a funnel-shaped outer part 13 and a tubular part 14. The tubular part defines a channel 15 through which the needle of a syringe passes to gain entry to compartment 7. Tubular portion 14 extends into compartment 7 and is in communication with the liquid material contained in that compartment via hole 16 in the side of the hard plastics material. A rubber seal 17 is positioned within channel 15 and prevents egress of liquid material from compartment 7. When the device is to be used, temporary seals 4 and 4*a* are ruptured, and the powdered drug contained in compartment 6 is mixed with the liquid in compartment 7 by shaking the device. Ceramic bead 11 aids in the mixing of the ingredients. When the powder has fully dissolved, a syringe is inserted into the needle entry device 12, and is pushed through the rubber seal 14 into the distal end 18 of tubular portion 14. The syringe action will then withdraw solution from the interior of the device 1 via hole 16, the ceramic bead 11 floating on the surface of solution and hence not interfering with the needle.

Figure 6:
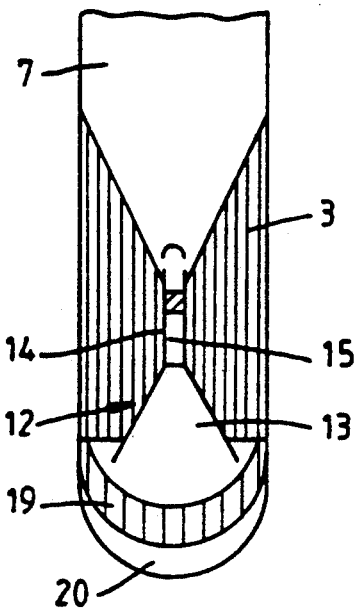
FIG. 6 illustrates a variant of the embodiment shown in FIG. 4.

Referring next to FIG. 6, a variant of the structure of FIG. 4 is shown. In this variant, entry to the needle entry device 13 is protected by means of a temporary heat seal 19 formed between two flaps of plastics material which constitute an extension of the tubular device 1 beyond the limits of end seal 3. The lowermost portions 20 of these two plastics flaps are left unsealed, so that the two flaps can readily be parted and then pulled to release temporary seal 19 and to permit access to channel 15.

Referring next to FIG. 7, the intermediate area 5 of a device in accordance with this invention is surrounded by a soft, clear plastics sheath 21. This provides some protection for temporary seals 4 and 4*a*, and also assists the user of the device when the temporary seals are to be broken.

In the embodiment of FIG. 8, a foil laminate 22 encapsulates the compartment 6, in order to protect the material contained in that compartment from environmental factors such as light and oxygen.

Referring next to FIG. 9, a rigid plastics end piece 23 is provided in the interior of the device at the "V"-shaped end 9 of compartment 7. A silicone rubber pad 10 is affixed to the exterior of tube 1 adjacent to a hole 24 in end piece 23. This arrangement permits access of a needle 25 which pierces rubber pad and passes through hole 24 into the interior of compartment 7. End piece 23 prevents the needle piercing end section 9 of compartment 7.

FIGS. 10–15 illustrate alternative arrangements whereby the end of compartment 7 may be protected from unwanted damage when a needle such as 25 is inserted into the device. In FIGS. 10 and 11, a hard, plastics sleeve 25 is fitted over the exterior of tube 1 in the vicinity of compartment 7 and end seal 3. The needle entry point is defined by rubber pad 10 which, as in the case of FIG. 9, is adjacent to an opening 26 in the hard sleeve 25.

FIG. 12 shows a variant which is applicable to any of the embodiments of the invention in which a rubber pad 10 is employed. In this variant, a peel-off protective strip 27 is applied to the exterior face of pad 10.

In FIGS. 13 and 14, a hard plastics clip 28 fits over part of end seal 3 and "V"-shaped end section 9 of compartment 7. A rubber pad 10 is again fixed to the exterior of clip 28 adjacent to an opening 29 in clip 28 to permit needle access. In FIG. 15, a rubber pad 10 is fixed to the outside wall of compartment 7 adjacent to end seal 3, and on the opposed region of compartment 7 there is provided a hard plastics disc 30 heat sealed onto the soft plastics material 1. Disc 30 provides a protective barrier preventing penetration of tube 1 by a needle inserted through pad 10 into compartment 7.

Referring to FIG. 16, the dispensing device has two generally linear end seals 2 and 3', and temporary seals 4' and 4*a*'. These temporary seals are oblique with respect to the longitudinal axis of the device, and extend from end seal 2 to the wall of tube 1. With the illustrated arrangement, compartment 7 is very much larger than compartment 6. This arrangement is particularly suitable for dispensing relatively large volumes of solution.

In a further embodiment of the invention the device is adapted to enable withdrawal of solution therefrom using a syringe with or without a needle.

Figure 17:
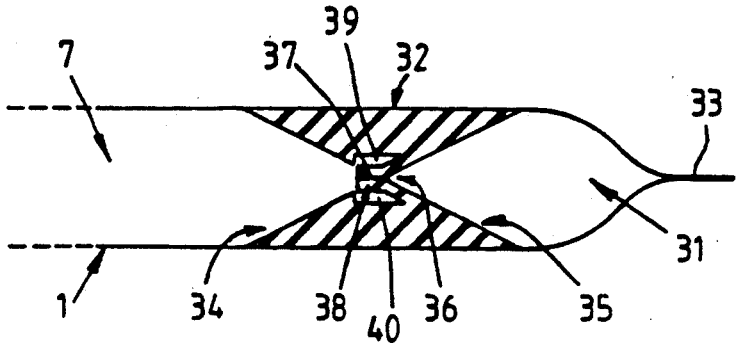
FIGS. 17, 18 and 19 illustrate three forms of an eighth embodiment of the invention.

Referring to FIG. 17, the tube 1 has a fourth compartment 31 which is defined by a rubber bung 32 at one end and a temporary seal 33 at the other end. The bung 32 defines a first "V"-shape 34 and a second "V"-shape 35. The latter allows the guidance of the syringe towards the valve 36. This valve 36 comprises two flaps 37 and 38, and two corresponding recesses 39 and 40. When the temporary seal 33 is broken by hand, a syringe may be inserted into the valve 36, forcing flaps 37 and 38 apart and into their corresponding recesses 39 and 40, respectively, thus facilitating entry into the compartment 7 and enabling extraction of the solution contained therein.

Figure 18:
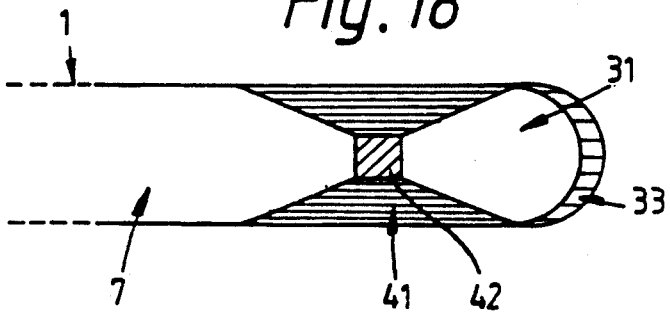

In FIG. 18 an alternative form of this embodiment is shown. The fourth compartment 31 is defined at one end by a temporary seal 33, as before, and at the other by a constriction 41. This constriction 41 defines a channel through which the lumen of a syringe may be inserted. This channel is sealed by a temporary seal 42 which is broken when the lumen of a syringe is inserted into the channel. The constriction 41 forms a "V"-shape which guides the syringe towards the temporary seal 42. In operation the temporary seal 33 is broken by hand, the syringe is inserted into the compartment 31 and is guided towards the temporary seal 42 by means of the "V"-shape formed by the constriction 41. The temporary seal 42 is broken by the end of the syringe and diluant from compartment 7 may be withdrawn.

Figure 19:
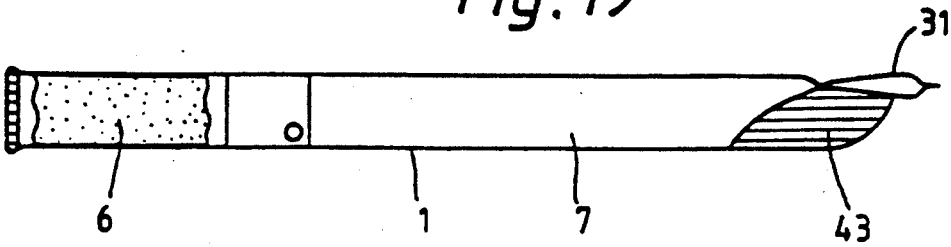
Figure 20:
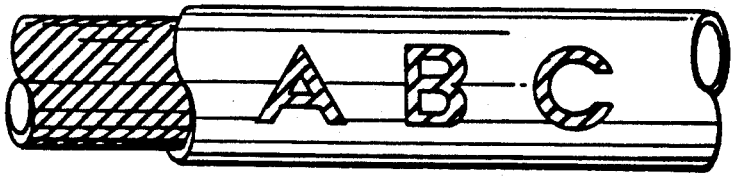
FIG. 20 illustrates a plastics container formed from two annularly co-extruded polymers.

FIG. 19 illustrates a further form of this embodiment, wherein the fourth compartment 31 has a permanently sealed area 43 which forms a flattened area which allows the device 1 to be held between the first finger and thumb while the needle and/or syringe is inserted into the entry channel.

In any of the above described embodiments the device may be constructed of annularly co-extruded polymers, the outer of these polymers being relatively more resilient than the inner. The outer polymer is of a different colour to that of the inner polymer, thereby allowing removal of the outer layer to generate indicia, for example, the name of the pharmaceutical and its dosage. This removal can, for example, be achieved by means of a laser.

In all of the above described embodiments the temporary seal 33 may have a pressure and/or moisture sensitive indicator between the two flaps of plastic which are sealed by temporary seal 33 to show accidental opening.

Where a device of this invention is to be used for intravenous or intramuscular drug administration, the overall procedure followed by clinical personnel may be considerably simpler than with conventional methods of drug administration. Conventional IV/IM drug administration involves the following sequence:

1. Check prescription chart for amount and type of medication.
2. Select and check drug bottle.
3. Check amount and type of fluid to be used as dilutant.
4. Make any necessary calculations, i.e. amount of fluid to be mixed with drug.
5. Pick-up and break ampoule of fluid. (Some ampoules without a break seal have to be filed at the end to open).
6. Insert syringe needle into ampoule.
7. Draw-up fluid.
8. Keep empty ampoule for checking purposes.
9. Pick up drug bottle.
10. Remove metal covering around drug bottle top.
11. Swab drug bottle top.
12. Insert needle of syringe dilutant into bottle top via rubber bung.
13. Add fluid from syringe to drug.
14. Withdraw needle.
15. Shake bottle to mix fluid and drug.
16. Re-insert needle into drug bottle.
17. Draw up mixture.
18. Withdraw needle.
19. Pick-up glass fluid ampoule and re-check fluid type, dosage, and expiry date.
20. Pick-up drug bottle and re-check drug type dosage and expiry date.
21. Administer drug to patient.
22. Dispose of both empty containers in special (expensive) "sharps" bin.

In contrast to this, the sequence required for use of a dispensing device in accordance with this invention is as follows:

1. Check prescription chart for amount and type of medication.
2. Select and check dispenser of the invention.
3. Break temporary seal using thumb and finger.
4. Shake to mix drug with correct measure and type of fluid.
5. Swab puncture point.
6. Insert syringe or syringe needle.
7. Draw-up drug mixture.
8. Withdraw syringe or needle.
9. Re-check dispenser for drug type and dosage.
10. Administer drug to patient.
11. Dispose of spent dispenser in any ward rubbish bag.

I claim:

1. A device which comprises a generally cylindrical plastics container at its ends having temporary seals therein to thereby divide the container into three compartments, one at each end and one intermediate those at each end, wherein that compartment of said container adjacent to one end thereof contains a first material and that compartment of said container adjacent to the other end thereof contains a second material in which the first material is to be dispersed or dissolved prior to use, characterized in that (a) said intermediate compartment contains a bed but neither said first material nor said second material, and (b) said temporary seals are arranged so that they can be broken by finger pressure to permit communication between the compartments, thereby permitting mixing of said first material and said second material.

2. A device as claimed in claim 1, wherein said first material is a powder, and said second material is a liquid.

3. A device as claimed in claim 2, wherein said powder is a measured weight of powdered pharmaceutical.

4. A device as claimed in claim 2, wherein said liquid is distilled water, normal saline solution or glucose solution.

5. A device as claimed in claim 1, wherein said bead has on its surface or is impregnated with an indicator sensitive to said liquid.

6. A device as claimed in claim 1, wherein said bead is ceramic.

7. A device as claimed in claim 1, wherein said bead is constructed from a buoyant material.

8. A device as claimed in claim 1, wherein said bead is conical, spherical, cylindrical, pyramidal or bi-pyramidal in shape.

9. A device as claimed in claim 1, wherein at least one of the ends of the device is sealed by a permanent heat seal.

10. A device as claimed in claim 1, wherein the seal at one end of the device defines a V-shaped end to the adjacent compartment.

11. A device as claimed in claim 1, wherein said device carries on its exterior a small pad which defines an intended puncture site and which assists in providing a seal around the lumen of a needle during withdrawal of the solution or suspension of said first and second materials.

12. A device as claimed in claim 11, wherein a peel off protective strip is affixed over said pad.

13. A device as claimed in claim 1, wherein said device includes at one end thereof an entry channel for a needle or for a syringe.

14. A device as claimed in claim 13, wherein said entry channel comprises a funnel which includes a valve at the neck of the funnel, which valve is penetrated in use, by the lumen of a needle or by the lumen of a syringe.

15. A device as claimed in claim 13, wherein said entry channel comprises a funnel which includes a seal at the neck of the funnel, which seal is penetrated in use, by the lumen of a needle.

16. A device as claimed in claim 15, wherein said funnel is constructed from a molded plastics or rubber material.

17. A device as claimed in claim 13, wherein said entry channel is protected by a temporary heat seal between flaps of plastics material at said one end of the dispensing device.

18. A device as claimed in claim 17, wherein said temporary heat seal has a pressure and/or moisture sensitive indicator between said flaps of plastic material.

19. A device as claimed in claim 13, wherein said entry channel has a substantially flattened area to assist holding of said device.

20. A device as claimed in claim 1, wherein the exterior of the device is surrounded in the vicinity of the intermediate compartment by a sheath of plastics material.

21. A device as claimed in claim 1, wherein the compartment of the device containing the first material is surrounded by a foil laminate.

22. A device as claimed in claim 1, wherein the temporary seals defining the intermediate compartment are linear and are disposed perpendicular to the longitudinal axis of the device.

23. A device as claimed in claim 1, wherein the temporary seals defining the intermediate compartment are arcuate in configuration, or are disposed obliquely with respect to the longitudinal axis of the device.

24. A device as claimed in claim 1, wherein said plastics container is formed from two annularly co-extruded polymers, the inner of said two polymers being relatively less resilient than the outer.

25. A device as claimed in claim 24, wherein each of said polymers is of a different color.

26. A device as claimed in claim 25, wherein predetermined portions of said outer polymer are removed to generate indicia.

27. A method for the production of a device according to claim 1, which comprises forming said container by extrusion; sealing one end thereof; depositing said first or second material into said container and sealing it therein by means of a temporary seal, depositing said bead into said container and sealing it therein by means of another temporary seal, thereby forming an intermediate compartment; depositing said first or second material into said container and sealing it therein by means of a further seal, wherein said temporary seals are formed by the application of heat to opposite sides of said container so as to cause the sides of the container to stick together without forming a permanent bond.

28. A method according to claim 27, wherein one or both of the seals at the ends of the device are formed by the application of heat and pressure to opposite sides of the container to generate a permanent heat seal.

29. A method of packaging a pharmaceutical material, which comprises forming a generally cylindrical plastics container by extrusion; sealing one end thereof; depositing a first material into said container adjacent to said sealed end and enclosing it in a first compartment therein by means of a temporary seal; depositing a bead into said container and sealing it therein by means of another temporary seal, thereby forming an intermediate compartment;

depositing a second material into said container and enclosing it therein in a third compartment by means of a further seal, wherein said first material is a pharmaceutical material and said second material is a diluent, or said first material is a diluent and said second material is a pharmaceutical material, and said temporary seals are formed by the application of heat to opposite sides of said container so as to cause the sides of the container to stick together without forming a permanent bond and are arranged so that they can be broken by finger pressure.

30. A method of dispensing a pharmaceutical material packaged in accordance with claim 29, which comprises breaking each temporary seal defining said intermediate compartment by applying finger pressure to the edges of the seals, shaking the container, and extracting the resulting solution, dispersion or suspension.

* * * * *